United States Patent [19]

Gannaway

[11] Patent Number: 4,838,769

[45] Date of Patent: Jun. 13, 1989

[54] HIGH SIDE SCOTCH YOKE COMPRESSOR

[75] Inventor: Edwin L. Gannaway, Adrian, Mich.

[73] Assignee: Tecumseh Products Company, Tecumseh, Mich.

[21] Appl. No.: 148,068

[22] Filed: Jan. 25, 1988

[51] Int. Cl.[4] ..... F04B 35/04; F04B 39/02

[52] U.S. Cl. ..... 417/312; 417/366; 417/419; 417/902

[58] Field of Search ..... 417/902, 312, 410, 366, 417/419, 372, 313, 523, 525

[56] References Cited

U.S. PATENT DOCUMENTS

| | | | |
|---|---|---|---|
| 2,065,162 | 12/1936 | Trask | 417/419 X |
| 3,807,907 | 4/1974 | Gannaway | 417/415 |
| 4,365,941 | 12/1982 | Tojo et al. | 417/410 X |
| 4,470,772 | 9/1984 | Gannaway | 417/368 |
| 4,645,429 | 2/1987 | Asami et al. | 417/312 |

*Primary Examiner*—Carlton R. Croyle
*Assistant Examiner*—Leonard P. Walnoha
*Attorney, Agent, or Firm*—Albert L. Jeffers; John F. Hoffman; David L. Ahlersmeyer

[57] ABSTRACT

A compressor assembly is disclosed including a compressor mechanism mounted within a hermetically sealed housing. The compressor mechanism includes a crankcase having a suction inlet opening providing direct communication into a suction cavity within the crankcase. The compressor mechanism is located in an upper chamber of the housing and a motor is located in a lower chamber, the entire interior of the housing being at discharge pressure. Suction gas is isolated from the motor so that heat from the motor does not increase the temperature of the suction gas. The discharge tube is positioned in the lower chamber so that discharge gas flows over the motor to cool it, thereby improving efficiency.

15 Claims, 3 Drawing Sheets

HIGH SIDE SCOTCH YOKE COMPRESSOR

BACKGROUND OF THE INVENTION

The present invention relates generally to a hermetic compressor assembly and, more particularly, to a direct suction compressor assembly having a crankcase mounted within a sealed housing, wherein suction gas is delivered directly to the crankcase from the suction line and compressed refrigerant is discharged into the sealed housing.

In general, prior art of hermetic compressor assemblies comprise a hermetically sealed housing having a compressor mechanism mounted therein. The compressor mechanism may include a crankcase or a cylinder block defining a compression chamber therein in which gaseous refrigerant is compressed and subsequently discharged. Typically, and especially in the case of a compressor having a pressurized housing, suction gas returning from a refrigeration system is provided to the compression chamber by means of a conduit extending from outside the housing to the compression chamber within the crankcase. This configuration is commonly referred to as a direct suction compressor. In such a compressor, it is known to introduce suction tubing through the housing and into a suction inlet opening in the crankcase or cylinder block that is in communication with the compression chamber. The portion of the tubing external of the housing may comprise part of a suction accumulator or may constitute a fitting to which a suction line of a refrigeration system may be attached.

U.S. Pat. No. 4,470,772 discloses a direct suction scotch yoke compressor wherein the pump portion of the compressor is disposed in an upper chamber and the motor is disposed in a lower chamber, the two being separated by a wall of the crankcase. The lower chamber in which the motor is disposed is at suction pressure due to vents 98 and passageways 94 which lead from the suction chamber to the lower motor chamber. A disadvantage to this design is that heat from the motor is imparted to the suction gas, thereby reducing efficiency. Furthermore, the discharge tube for the high pressure discharge gas is located in the upper chamber, thereby isolating the motor from discharge gas and necessitating that the motor be cooled solely by the oil.

SUMMARY OF THE INVENTION

The present invention, in one form there of, is a scotch yoke, high side compressor having a direct suction connection to the yoke cavity. The pump portion of the compressor is located in an upper chamber which connects to the lower motor chamber through a muffler, thereby placing the entire interior of the hermetic housing at discharge pressure. This enables the suction gas to be isolated from the heat of the motor, thereby improving efficiency. Furthermore, the discharge tube is located in the motor chamber of the compressor so that discharge gas is utilized to cool the motor, thereby resulting in even further improvements in efficiency. Because the pump portion of the compressor is located in the upper chamber, heat generated thereby is radiated upwardly through the housing. The scotch yoke design of the compressor results in very good dynamic balancing, and the compressor can be directly connected to the housing without necessity for using mounting springs.

The various features discussed above all combine to result in a hermetic compressor which runs quietly and smoothly, and which is extremely efficient.

The invention, in one form thereof, is a hermetic compressor having a hermetically sealed housing and means dividing the housing into an upper chamber and a lower chamber. A vertically oriented scotch yoke motor compressor unit is disposed in said housing and comprises a compressor mechanism in the upper chamber and a motor drivingly connected to the compressor mechanism and being positioned in the lower chamber. The compressor mechanism comprises a crankcase having a yoke cavity therein at suction pressure and a plurality of cylinders and a scotch yoke mechanism connected to a vertical crankshaft driven by the motor for compressing refrigerant gas in the cylinders. A suction conduit is connected directly to the yoke cavity, and a discharge conduit is connected to the lower chamber, the lower chamber and upper chamber being at discharge pressure, whereby discharge gas is discharged through the lower chamber to thereby cool the motor.

The invention further provides, in one form thereof, a hermetic compressor comprising a hermetically sealed housing and a vertical shaft scotch yoke compressor mechanism disposed in an upper portion of the housing, the compressor mechanism comprising a crankcase with a plurality of radially arranged cylinders therein and a yoke cavity disposed centrally of the cylinder and being at suction pressure. The mechanism includes a mounting flange or base portion that is generally below the cylinders and that divides the housing into an upper chamber and a lower chamber, the base portion being rigidly peripherally connected to the housing. The compressor mechanism includes a scotch yoke means comprising a vertical crankshaft and a plurality of pistons connected to the crankshaft and disposed in the cylinders for compressing gas in the cylinders and discharging the compressed gas into the housing. A motor is disposed in the lower chamber and is drivingly connected to the crankshaft, and a lubricant sump is positioned in the lower chamber such that an oil pump connected to the crankshaft extends into the sump. A suction intake conduit extends through the housing and is connected directly to the yoke cavity, and a discharge conduit extends into the housing lower chamber, the upper and lower chambers being in communication with each other and being at discharge pressure whereby suction gas is isolated from the motor and the motor is cooled by discharge gas.

DESCRIPTION OF THE PREFERRED EMBODIMENT

Figure 1:
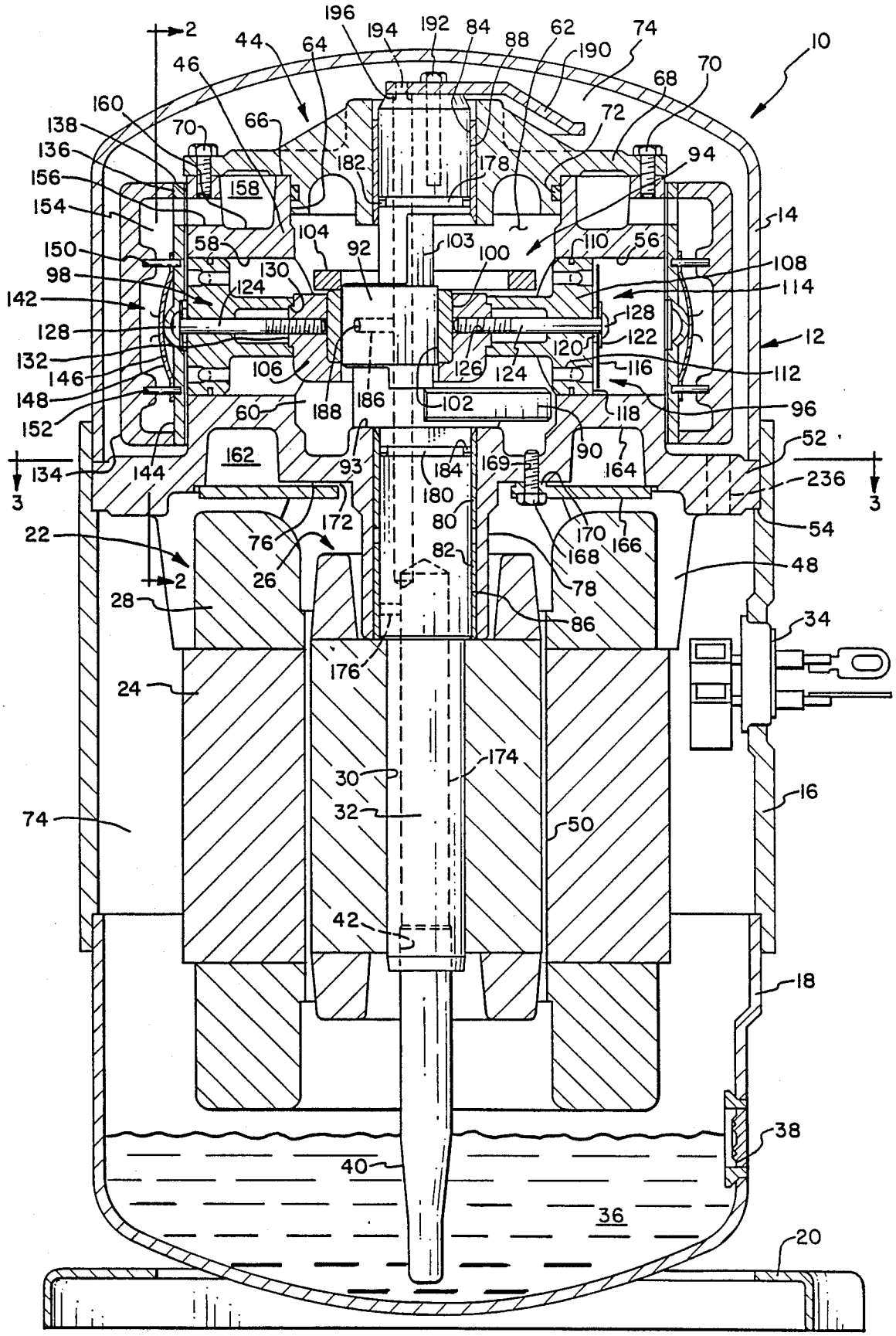
FIG. 1 is a side sectional view of a compressor of the type to which the present invention pertains.

In an exemplary embodiment of the invention as shown in the drawings, and in particular by referring to FIG. 1, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment of FIG. 1, is a scotch yoke compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. The lower portion of crankcase 46 and mounting flange 52 serve to divide the interior of the housing 12 into an upper chamber in which the compressor mechanism 44 is mounted and a lower chamber in which motor 22 is disposed. A passage 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an 0-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

A sleeve bearing, as referred to herein, is defined as a generally cylindrical bearing surrounding and providing radial support to a cylindrical portion of a crankshaft, as opposed to a thrust bearing which provides axial support for the weight of the crankshaft and associated parts. A sleeve bearing, for example, may comprise a steel-backed bronze sleeve insertable into a crankcase, or a machined cylindrical surface made directly in the crankcase casting or another frame member.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100 A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 116 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket 138 is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts 135, shown in FIG. 2. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and valve plate gasket 138.

Figure 3:
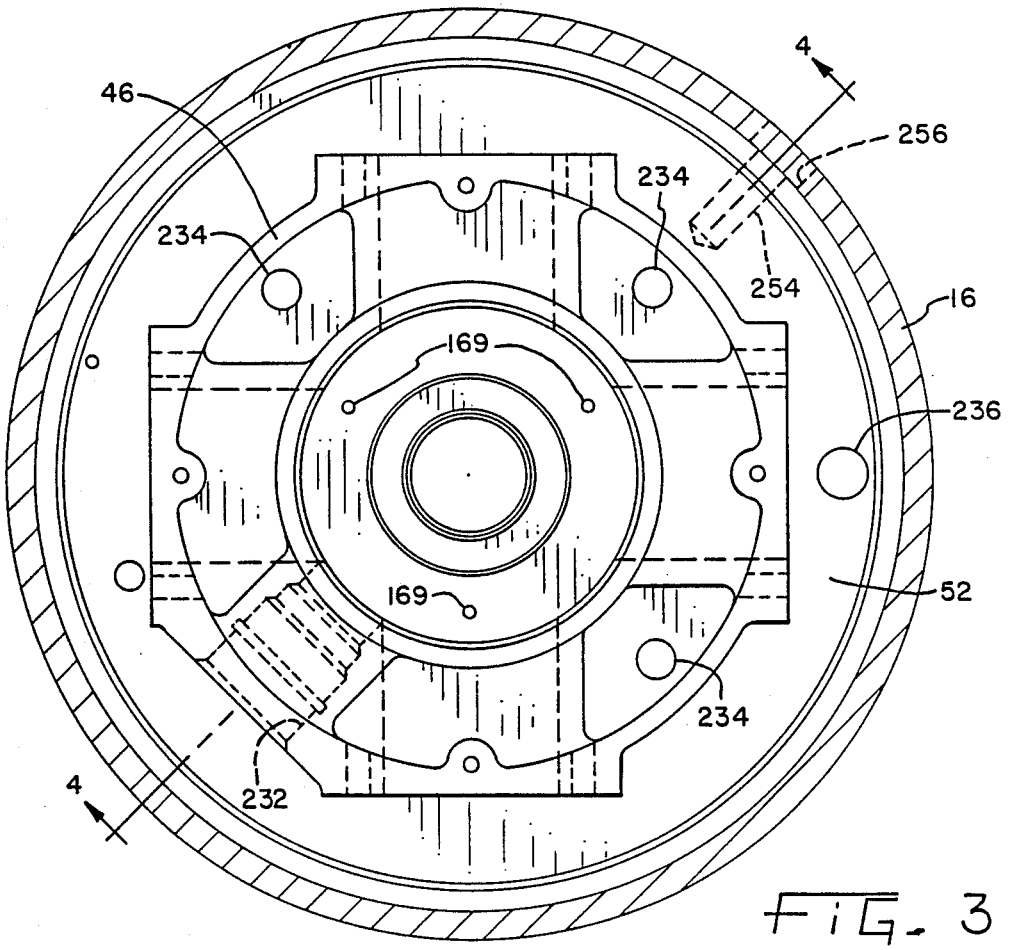
FIG. 3 is a top view of the crankcase of the compressor of FIG. 1, showing a sectional view of the housing taken along the line 3—3 in FIG. 1 and viewed in the direction of the arrows.
Figure 4:
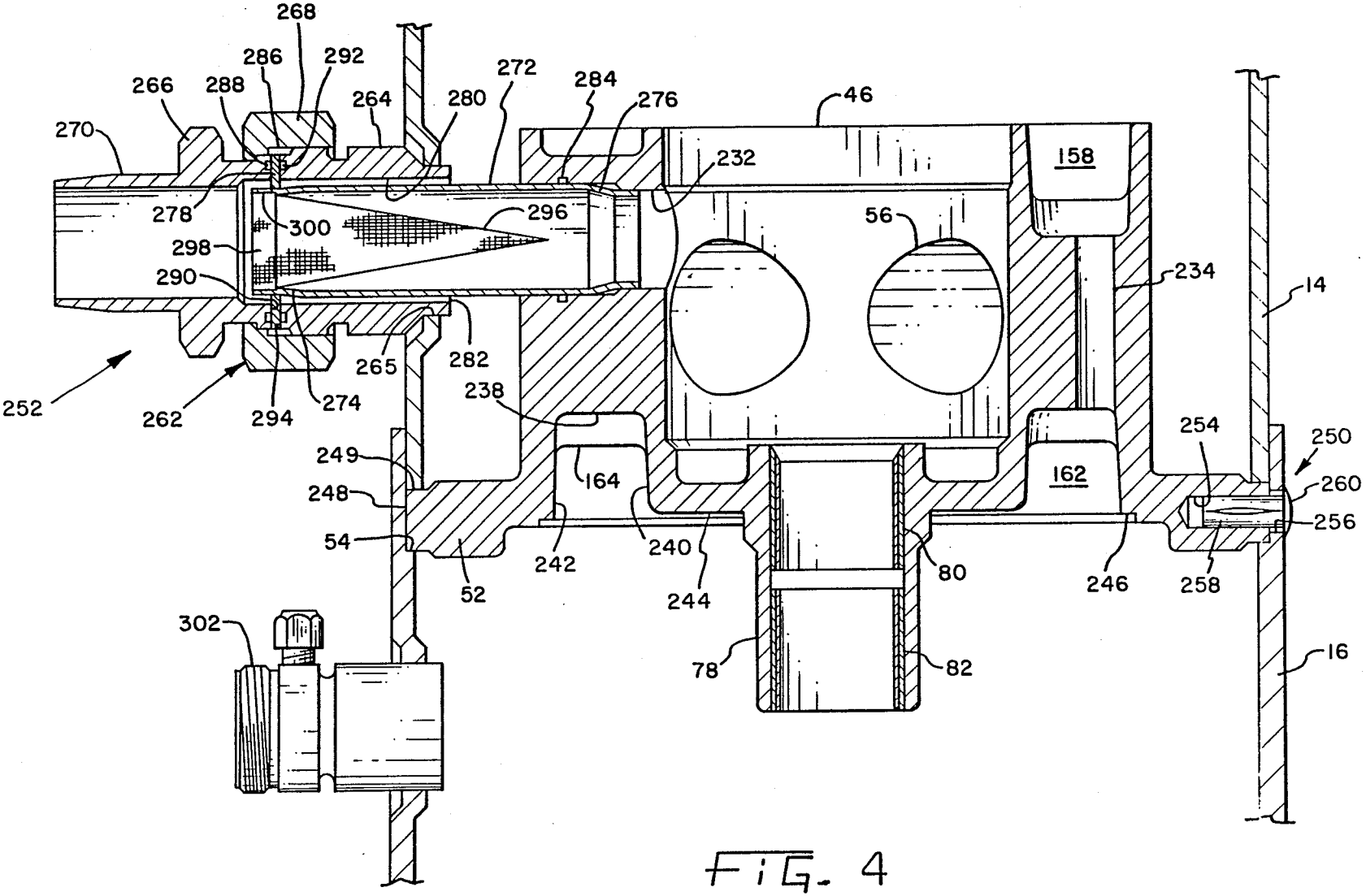
FIG. 4 is a fragmentary sectional view of the crankcase and housing assembly of FIG. 3 taken along the line 4—4 in FIG. 3 and viewed in the direction of the arrows, particularly showing the suction line and discharge outlet.

Top muffling chamber 158 communicates with a bottom muffling chamber 162 by means of passageways extending through crankcase 46. Chamber 162 is defined by an annular channel 164 and a muffler cover plate 166. Cover plate 166 is mounted against bottom surface 76 at a plurality of circumferentially spaced locations by bolts 168 and threaded holes 169 (FIG. 3). Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172 that faces motor 22. The radially outward extreme portion of cover plate 166 is biased in engagement with bottom surface 76 to prevent escape of discharge gas from within bottom muffling chamber 162 at this radially outward location. Discharge gas flows from the upper chamber, through muffler 162 and out annular exhaust port 172 into the lower chamber whereupon it contacts motor 22 and cools the motor, thereby improving efficiency of the motor operation. The discharge gas then flows outwardly through discharge tube 302 (FIG. 4).

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Figure 2:
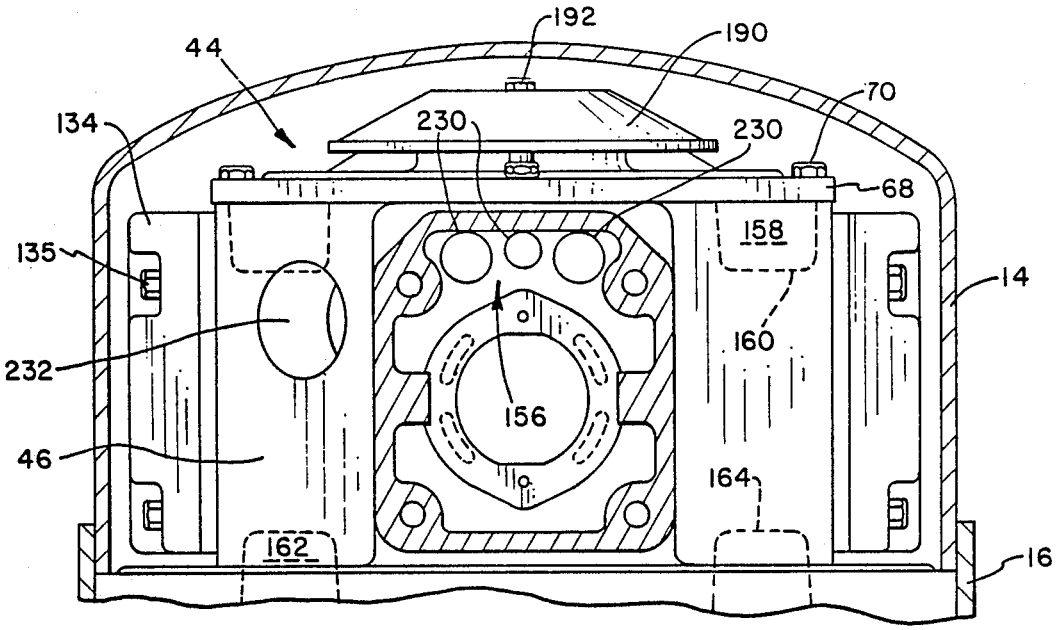
FIG. 2 is a fragmentary sectional view of the compressor of FIG. 1 taken along the line 2—2 in FIG. 1 and viewed in the direction of the arrows.

Referring now to FIG. 2, an upper portion of compressor mechanism 44 is shown to better illustrate the disclosed valve system and discharge muffling system. More specifically, FIG. 2 further shows connecting passage 156 of FIG. 1 as comprising a plurality of bores 230, associated with each radially disposed cylinder arrangement, to connect between discharge space 154 within cylinder head cover 134 and top muffling chamber 158. Also shown in FIG. 2 is a suction inlet opening 232 included in crankcase 46, providing communication between the outside of the crankcase and suction cavity 60 defined therein.

FIGS. 3 and 4 provide views of the crankcase showing three gas passageways 234 extending through crankcase 46 and providing communication between top muffling chamber 158 and bottom muffling chamber 162. In the preferred embodiment, the combined cross-sectional area of gas passageways 234 is made approximately equal to that of bores 230 associated with one cylinder to avoid pressure drops. Vent passageway 236 connects the upper and lower chambers.

Referring now to FIG. 4, gas passageways 234 open into annular channel 164 comprising a bottom wall 238, a radially inner sidewall 240, and a radially outer sidewall 242. Bottom wall 238 extends to a greater depth between adjacent cylinders and is necessarily shallower at the location of each cylinder. It is also noted that annular channel 164 circumscribes bearing portion 78 in which crankshaft 32 is journalled.

Bottom surface 76 of crankcase 46 is provided with an inner annular ledge 244 and an outer annular ledge 246 comprising the adjacent top surfaces of inner sidewall 240 and outer sidewall 242, respectively. Referring to the combination of FIGS. 1 and 4, cover plate 166 is fixedly attached to inner ledge 244 by means of three bolts 168 engaging crankcase 46 in threaded holes 169. The radially outermost portion of cover plate 166 is biased in engagement with outer ledge 246. Two exemplary methods of effecting such a biased condition are as follows. First, where cover plate 166 is substantially flat, inner ledge 244 may be in a recessed, parallel offset plane with respect to outer ledge 246. The degree to which inner ledge 244 is recessed depends upon the thickness of spacers 170 and the amount of force necessary at the outermost portion of cover plate 166 to prevent rattling of the cover plate against outer ledge 246. Second, the outermost portion of cover plate 166 may be maintained in biased engagement against outer ledge 246 by making cover plate 166 dish-shaped, such as a bellville washer. In this arrangement, inner ledge 244 and outer ledge 246 may be substantially coplanar.

Specific reference will now be made to FIGS. 3 and 4 for a more detailed description of a mounting pin assembly 250 for preventing rotational movement of crankcase 46 within housing 12. Mounting flange 52 is axially supported within annular ledge 54. The outside diameter of flange 52 is spaced slightly, i.e., 0.005–0.010 inches, from central portion 16 at annulus 248 to prevent binding when expansion and contraction of the housing occurs due to pressure and temperature conditions. Also, there is planar contact between top portion 14 and flange 52 at 249, or perhaps a few thousandths of an inch clearance. Preferably, a clamping force at 249 is avoided so as to reduce stresses and associated noise.

A single mounting pin assembly 250 is provided diametrically opposed 180° from a suction fitting assembly 252. Mounting pin assembly 250 comprises a radially outwardly opening hole 254 in flange 52. An aperture 256 in substantial alignment with hole 254 is provided in central portion 16 of the housing. A notched pin 258 is frictionally engaged within hole 254 and extends into aperture 256. A weld is made between pin 258 and central portion 16 at aperture 256, represented in FIG. 4 by weldment 260.

Referring now to suction fitting assembly 252, there is provided a housing fitting assembly 262 comprising a housing fitting member 264, a removable outer fitting member 266, and a threaded nut 268. Housing fitting member 264 is received within an aperture 265 in top portion 14 of the housing, and is sealingly attached thereto as by welding, brazing, soldering, or the like. Outer member 266 includes a steel nipple 270 into which suction tubing of a refrigeration system may be received and brazed or soldered thereto. Threaded nut 268 is rotatable, yet axially retained, on outer fitting member 266. Housing fitting member 264 is a slightly modified version of a fitting commercially available from Primor of Adrian, Mich.

Suction fitting assembly 252 further includes a suction tube insert 272 comprising a short length of spun or swedged cylindrical tubing having a first end 274 and a second end 276. A ring-like flange 278, such as a stamped steel washer, is secured to the outside diameter of end 274 and extends radially outwardly therefrom. Flange 278 is secured to end 274 by means of brazing, soldering, clinching or welding. Housing fitting assembly 262, and particularly housing member 264 and outer member 266, includes a fitting bore 280 in which suction tube insert 272 axially resides. More specifically, the diameter of insert 272 is less than the diameter of bore 280 such that an annular clearance 282 is provided therebetween. In the preferred embodiment, clearance 282 is 0.050 inches circumferentially about insert 272.

An annular space 286 is provided between the outside diameter of flange 278 and the inside diameter of threaded nut 268. The combination of annular space 286 and annular clearance 282 permits random movement of tube insert 272 within bore 280, whereby the axis of insert tube 272 is substantially parallel to and selectively spaced relative to the axis of fitting bore 280.

Flange 278 is sealingly retained between housing fitting member 264 and outer fitting member 266. Specifically, an annular sealing ring 288 is interposed between sealing surface 290 of outer member 266, and flange 278. Likewise, an annular sealing ring 292 is interposed between a sealing surface 294 of housing member 264, and flange 278. Sealing rings 288, 292 may be composed of a rubber material such as neoprene or viton. In the preferred embodiment, annular sealing rings 288, 292 are retained within grooves in sealing surfaces 290, 294, respectively. Accordingly, flange 278 is sealingly secured between housing fitting member 264 and outer fitting member 266 when threaded nut 268 draws the two members together.

The suction fitting assembly further comprises a conical screen filter 296 including a mounting ring 298 at the base end thereof. Mounting ring 298 slip fits into a counterbore 300 provided in first end 274 of suction tube insert 272. In such an arrangement, filter 296 may be easily removed for cleaning or replacement.

As can be appreciated, the suction gases that pass into the yoke cavity are completely isolated from the lower chamber in which motor 22 is mounted. This results in improved efficiency because heat from motor 22 is not imparted to the suction gases.

FIG. 4 also shows a discharge fitting 302 provided in central portion 16 of housing 12 located directly beneath suction fitting assembly 252. The location of discharge fitting 302 in a central or lower portion of the housing provides an advantage in that the fitting acts as a dam and limits to about 20 lbs. the amount of refrigerant charge that will be retained by the compressor and required to be pumped out upon startup.

It will be appreciated that the foregoing is presented by way of illustration only, and not by way of any limitation, and that various alternatives and modifications may be made to the illustrated embodiment without departing from the spirit and scope of the invention.

What is claimed is:

1. A hermetic compressor comprising:

a hermetically sealed housing, means dividing said housing into an upper chamber and a lower chamber, a vertically oriented scotch yoke motor compressor unit in said housing comprising a compressor mechanism in said upper chamber and a motor positioned in said lower chamber and being drivingly connected to said compressor mechanism, said compressor mechanism comprising a crankcase having a yoke cavity therein at suction pressure and a plurality of cylinders and a scotch yoke means connected to a vertical crankshaft driven by said motor for compressing refrigerant gas in said cylinder, said crankshaft partially disposed in said yoke cavity and extending into said lower chamber, said yoke cavity being in said upper chamber, a suction conduit connected directly to said yoke cavity and sealed from said chambers, a discharge conduit connected to said lower chamber, said lower chamber and upper chamber being at discharge pressure, whereby discharge gas is discharged through said lower chamber to thereby cool said motor, and seal means on said crankshaft for sealing said yoke cavity from said lower chamber.

2. The compressor of claim 1 wherein said means dividing said housing into an upper chamber and a lower chamber includes a discharge muffler means.

3. The compressor of claim 2 wherein said muffler means includes an annular discharge gap opening into said lower chamber concentrically with said crankshaft.

4. The compressor of claim 2 and including a vent passageway connecting said upper and lower chambers.

5. The compressor of claim 2 wherein said discharge conduit is connected to an upper portion of said lower chamber.

6. The compressor of claim 1 including an oil sump in the lower chamber and oil pump means connected to said crankshaft for pumping oil from the sump upwardly through said crankshaft into said upper chamber.

7. The compressor of claim 6 wherein said oil pump means is a centrifugal oil pickup tube connected to one end of said crankshaft and extending into said sump.

8. A hermetic compressor comprising:

a hermetically sealed housing, a vertical shaft scotch yoke compressor mechanism disposed in an upper portion of said housing, said compressor mechanism comprising a crankcase with a plurality of radially arranged cylinders therein and a yoke cavity disposed centrally of said cylinders and being at suction pressure, said crankcase including a base portion generally below said cylinders that divides said housing into an upper chamber and a lower chamber, said base portion being peripherally connected to said housing, said compressor mechanism including scotch yoke means comprising a vertical crankshaft partially disposed in said yoke cavity and extending into said lower chamber and a plurality of pistons connected to said crankshaft and disposed in said cylinders for compressing gas in said cylinders and discharging the compressed gas into said housing, said compressor mechanism including seal means on said crankshaft for sealing said yoke cavity from said lower chamber, a motor disposed in said lower chamber and being drivingly connected to said crankshaft, a lubricant sump in said lower chamber, oil pump means connected to said crankshaft for lubricating said compressor mechanism, said oil pump means extending into said sump, a suction intake conduit extending through said housing and being connected directly to said yoke cavity, and a discharge conduit extending into said lower chamber, said upper and lower chambers being in communication with each other and being at discharge pressure, whereby suction gas is isolated from said motor and said motor is cooled by discharge gas.

9. The compressor of claim 8 wherein said discharge conduit is positioned in an upper portion of said lower chamber and functions to carry away excess lubricant in said lower chamber if the level of the lubricant reaches the height of said discharge conduit.

10. The compressor of claim 8 including a discharge muffler chamber in said base portion of said compressor mechanism, said muffler including an outlet that opens into said lower chamber.

11. The compressor of claim 10 wherein said muffler outlet faces said motor to thereby discharge gas directly on said motor.

12. The compressor of claim 11 wherein said muffler outlet is annular and is disposed generally concentrically around said crankshaft.

13. The compressor of claim 10 wherein said muffler outlet is annular and is disposed generally concentrically around said crankshaft.

14. The compressor of claim 8 wherein said pistons include suction valve means thereon for conducting gas from said yoke cavity, through said pistons and into cylinder heads on said crankcase.

15. A hermetic compressor comprising:

a hermetically sealed housing, said housing having an upper chamber and a lower chamber, a vertically oriented scotch yoke motor compressor unit in said housing comprising a compressor mechanism in said upper chamber and a motor positioned in said lower chamber and being drivingly connected to said compressor mechanism, said compressor mechanism comprising a crankcase having a yoke cavity therein at suction pressure and a plurality of cylinders and a scotch yoke means connected to a vertical crankshaft driven by said motor for compressing refrigerant gas in said cylinder, said scotch yoke means including pistons disposed in said cylinders and having suction valve means thereon for passing gas through said cylinders and into cylinder heads on said crankcase, said crankshaft being partially disposed in said yoke cavity, a suction conduit connected directly to said yoke cavity, sand a discharge conduit connected to said lower chamber, said lower chamber and upper chamber being at discharge pressure, whereby discharge gas is discharged through said lower chamber to thereby cool said motor, and seal means on said crankshaft for sealing said yoke cavity from said lower chamber.

* * * * *